United States Patent [19]

Carter

[11] 4,341,388

[45] Jul. 27, 1982

[54] DRIVING GAME BOARD APPARATUS

[76] Inventor: John Carter, 1157 Marine Dr., West Vancouver, British Columbia, Canada

[21] Appl. No.: 225,872

[22] Filed: Jan. 19, 1981

[51] Int. Cl.[3] ..... A63F 3/00

[52] U.S. Cl. ..... 273/248

[58] Field of Search ..... 273/248, 249, 242, 243, 273/287, 246; D21/32, 34, 35

[56] References Cited

U.S. PATENT DOCUMENTS

| | | | |
|---|---|---|---|
| 695,303 | 3/1902 | Graham | 273/249 |
| 2,006,176 | 6/1935 | Quine | 273/248 |
| 2,178,330 | 10/1939 | Thomas | 273/254 |
| 3,606,334 | 9/1971 | Pippin | 273/248 |

FOREIGN PATENT DOCUMENTS

| | | | |
|---|---|---|---|
| 798725 | 7/1958 | United Kingdom | 273/252 |

*Primary Examiner*—Richard C. Pinkham

*Assistant Examiner*—Scott L. Brown

*Attorney, Agent, or Firm*—Townsend and Townsend

[57] ABSTRACT

Driving game apparatus including a game board with an endless two-way course thereon extending around a central area and having inner and outer lanes. A plurality of individual home areas are arranged around the central area and each has an identification different from the others. A plurality of playing pieces simulating vehicles are used, there being one playing piece for each home area and having the identification of the latter. An in-out pathway extends between each home area and the roadway course. A plurality of inward and outward detour roads extend from the central area to the roadway course, and there are a plurality of indicator sections on the pathways, the roadway course and the detour roads, and a plurality of individual instruction cards, these sections and cards containing different driving instructions, penalties and awards. The game is played with chance number indicating means, such as dice.

7 Claims, 9 Drawing Figures

Figure 2A:
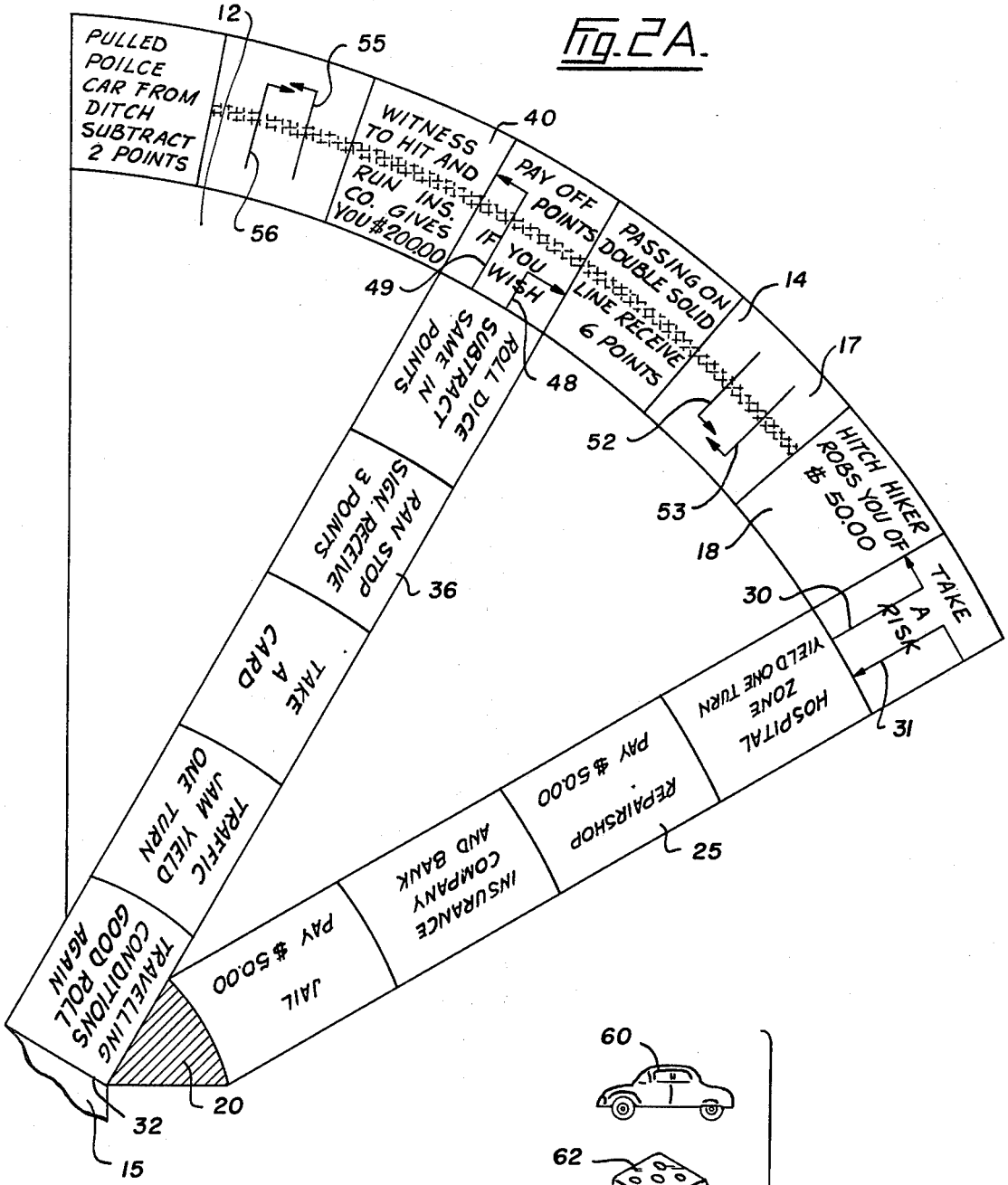

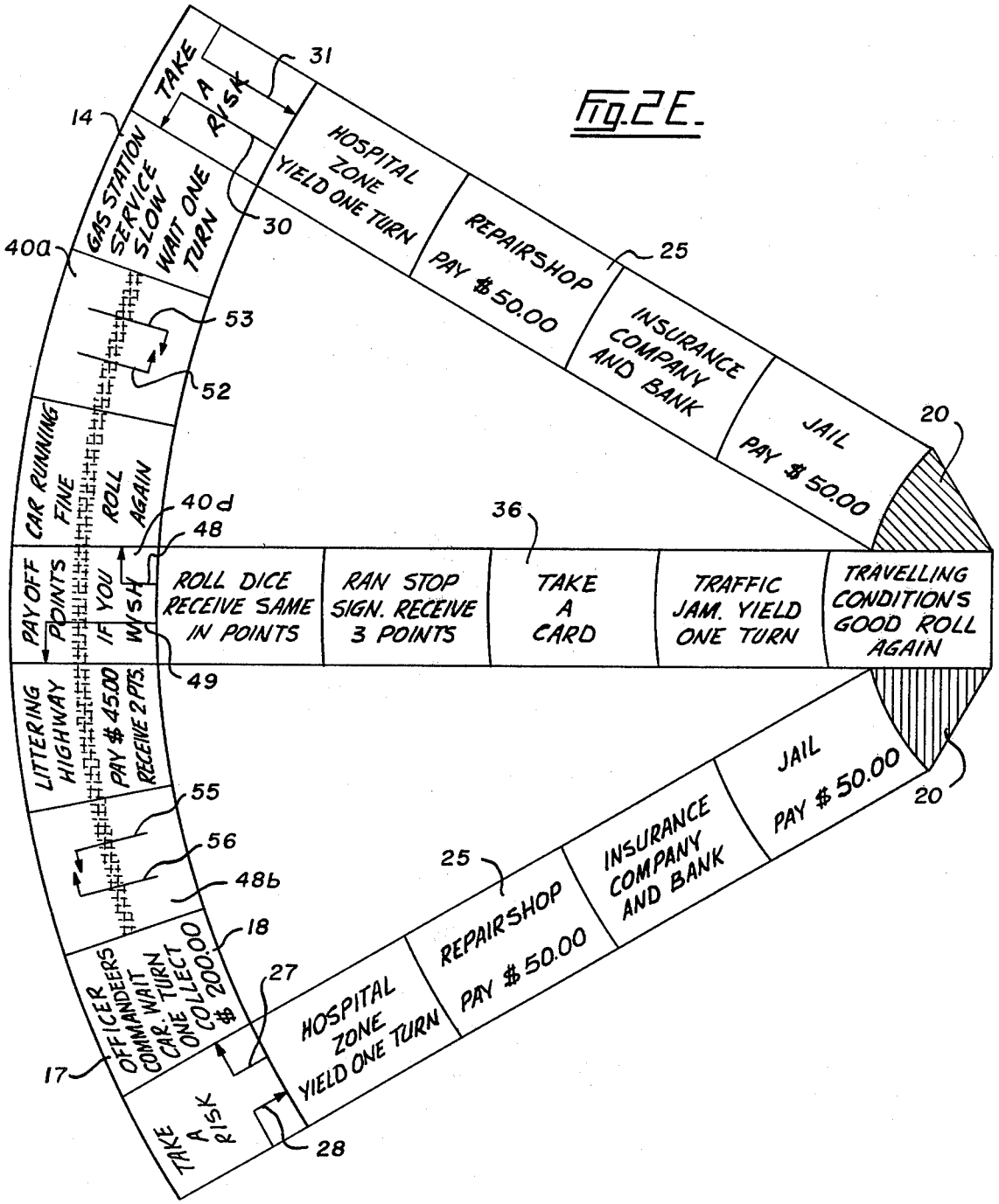
Fig. 2E.
TAKE A RISK
31
14
GAS STATION SERVICE SLOW WAIT ONE TURN
30
HOSPITAL ZONE YIELD ONE TURN
REPAIRSHOP PAY $50.00
25
INSURANCE COMPANY AND BANK
JAIL PAY $50.00
20
40a
53
52
CAR RUNNING FINE ROLL AGAIN
40d
48
36
PAY OFF POINTS IF YOU WISH
ROLL DICE RECEIVE SAME IN POINTS
RAN STOP SIGN. RECEIVE 3 POINTS
TAKE A CARD
TRAFFIC JAM. YIELD ONE TURN
TRAVELLING CONDITIONS GOOD ROLL AGAIN
49
LITTERING HIGHWAY PAY $45.00 RECEIVE 2 PTS.
55
56
48b
18
OFFICER COMMANDEERS CAR. WAIT ONE TURN COLLECT $200.00
27
17
TAKE A RISK
28
HOSPITAL ZONE YIELD ONE TURN
REPAIRSHOP PAY $50.00
25
INSURANCE COMPANY AND BANK
JAIL PAY $50.00
20

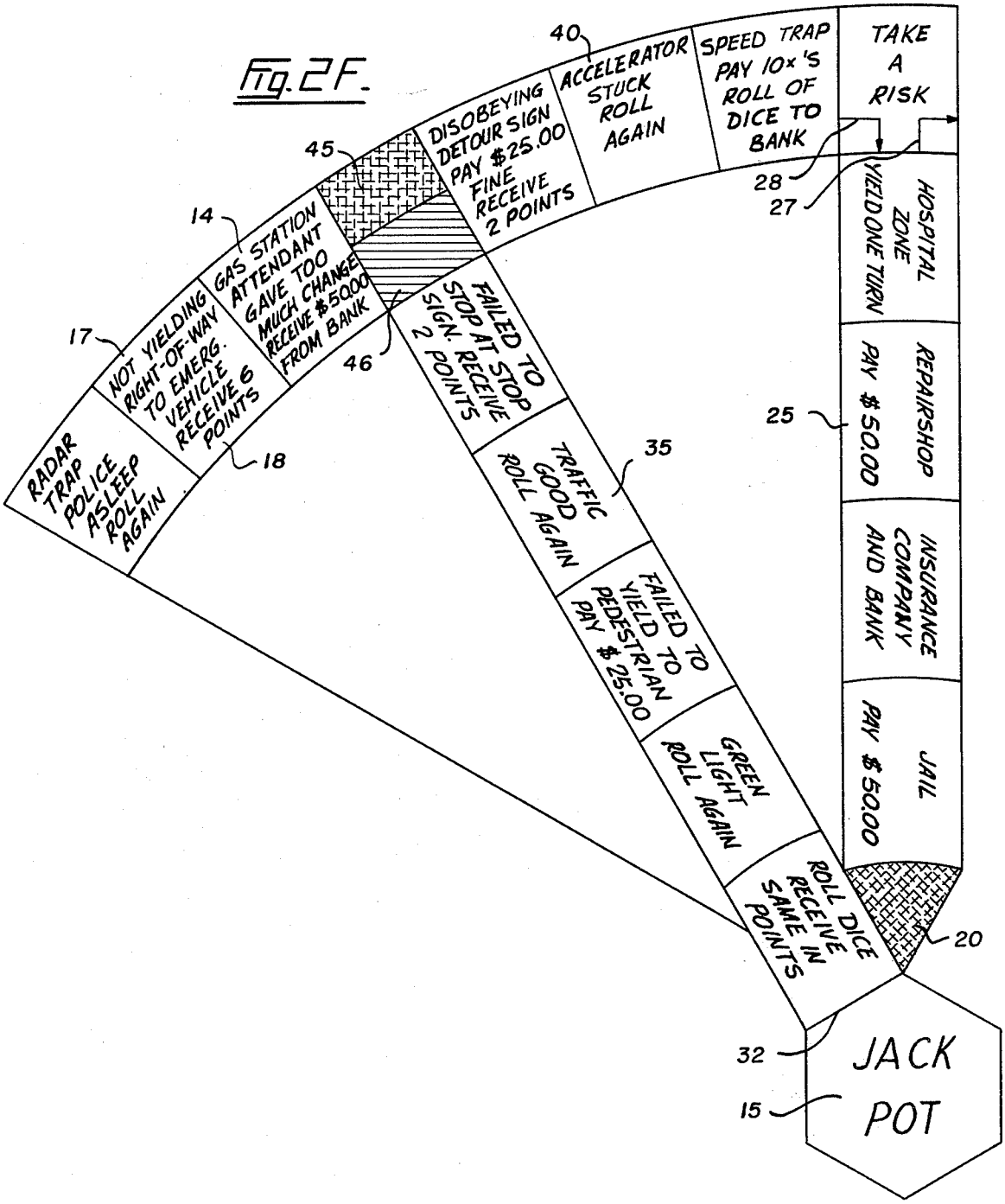
Fig. 2F.
TAKE A RISK
SPEED TRAP PAY 10x'S ROLL OF DICE TO BANK
ACCELERATOR STUCK ROLL AGAIN
DISOBEYING DETOUR SIGN PAY $25.00 FINE RECEIVE 2 POINTS
GAS STATION ATTENDANT GAVE TOO MUCH CHANGE RECEIVE $5.00 FROM BANK
NOT YIELDING RIGHT-OF-WAY TO EMERG. VEHICLE RECEIVE 6 POINTS
RADAR TRAP POLICE ASLEEP ROLL AGAIN
FAILED TO STOP AT STOP SIGN. RECEIVE 2 POINTS
TRAFFIC GOOD ROLL AGAIN
FAILED TO YIELD TO PEDESTRIAN PAY $25.00
GREEN LIGHT ROLL AGAIN
ROLL DICE RECEIVE SAME IN POINTS
JACK POT
JAIL PAY $50.00
INSURANCE COMPANY AND BANK
REPAIRSHOP PAY $50.00
HOSPITAL ZONE YIELD ONE TURN
14
17
18
20
25
27
28
32
15
35
40
45
46

DRIVING GAME BOARD APPARATUS

This invention relates to board apparatus for use in a game simulating actual driving conditions with different driving instructions, penalties and awards. Some of the prior games simulate the movement of vehicles, but none simulates the actual driving conditions to which a person is subjected during normal travel on the public streets and roads. The only patents of which the applicant is aware along these lines are U.S. Pat. Nos. 4,030,762, 3,990,707, 2,484,051, 1,616,328, U.S. Pat. Des. Nos. D202,360, D113,005 and D76989; British Pat. No. 523,310; and French Pat. Nos. 1,238,838 and 838,588.

The game of U.S. Pat. No. 3,990,707 is the closest to the present game apparatus. The game has a board with streets thereon and a plurality of locations representing stores, motels and the like. Playing pieces simulating trucks and soft drink cases, game cards, and dice are used. The game has to do with route salesman delivering the soft drink cases.

The game board apparatus of the present invention includes a game board having an endless two-way roadway course extending around a central area. A plurality of individual home or start areas are located at the central area, and an in-out pathway extends from each home area to the roadway course. There are detour roads extending between the roadway course and the central area. A plurality of indicator sections are provided in succession on the pathways, the roadway course and the detour roads, said sections containing different driving instructions, penalties and awards. If desired, instruction cards containing penalties and awards may be used. Each home area has an identification different from the others, and there is a playing piece simulating a vehicle for each home area and having the same identification. The roadway course has inner and outer lanes for playing piece movement in opposite directions. Some of the indicator sections have arrows for directing playing pieces from the proper lane thereof to the opposite lane for movement in the same direction as or in the opposite direction to the movement of the pieces in their proper lanes. Others of the indicator sections contain information for playing pieces landing on them, such as fines for traffic violations, traffic problem instructions, or awards for good driving, and the like. Indicator sections in the two lanes of the roadway course and having the identifications of two different playing pieces are located at the ends of some of the detour roads so as to cause the respective playing pieces to leave the main roadway course and travel on these roads.

The present apparatus is quite different from any of the games illustrated and described in the above-mentioned patents and provides a novel form of amusement.

Driving game board apparatus in accordance with the present invention comprises a game board, an endless two-way roadway course on the board spaced outwardly from and extending around a central area of the board, said roadway course having an inner lane and an outer lane extending throughout the length thereof, a plurality of individual home areas arranged around the central area of the board, each of said home areas having an identification different from the others of said home areas, a plurality of playing pieces simulating vehicles, one for each home area and having the identification of said each home area, an in-out pathway extending between each home area and the roadway course, some of said pathways communicating with the outer lane and some of said pathways communicating with the inner lane, a plurality of inward detour roads extending from the inner and outer lanes to said central area, a plurality of outward detour roads extending from the central area to the inner and outer lanes, and a plurality of indicator sections in succession on the pathways, the roadway course and the inward and outward detour roads and containing different driving instructions, penalties and awards.

Figure 1:
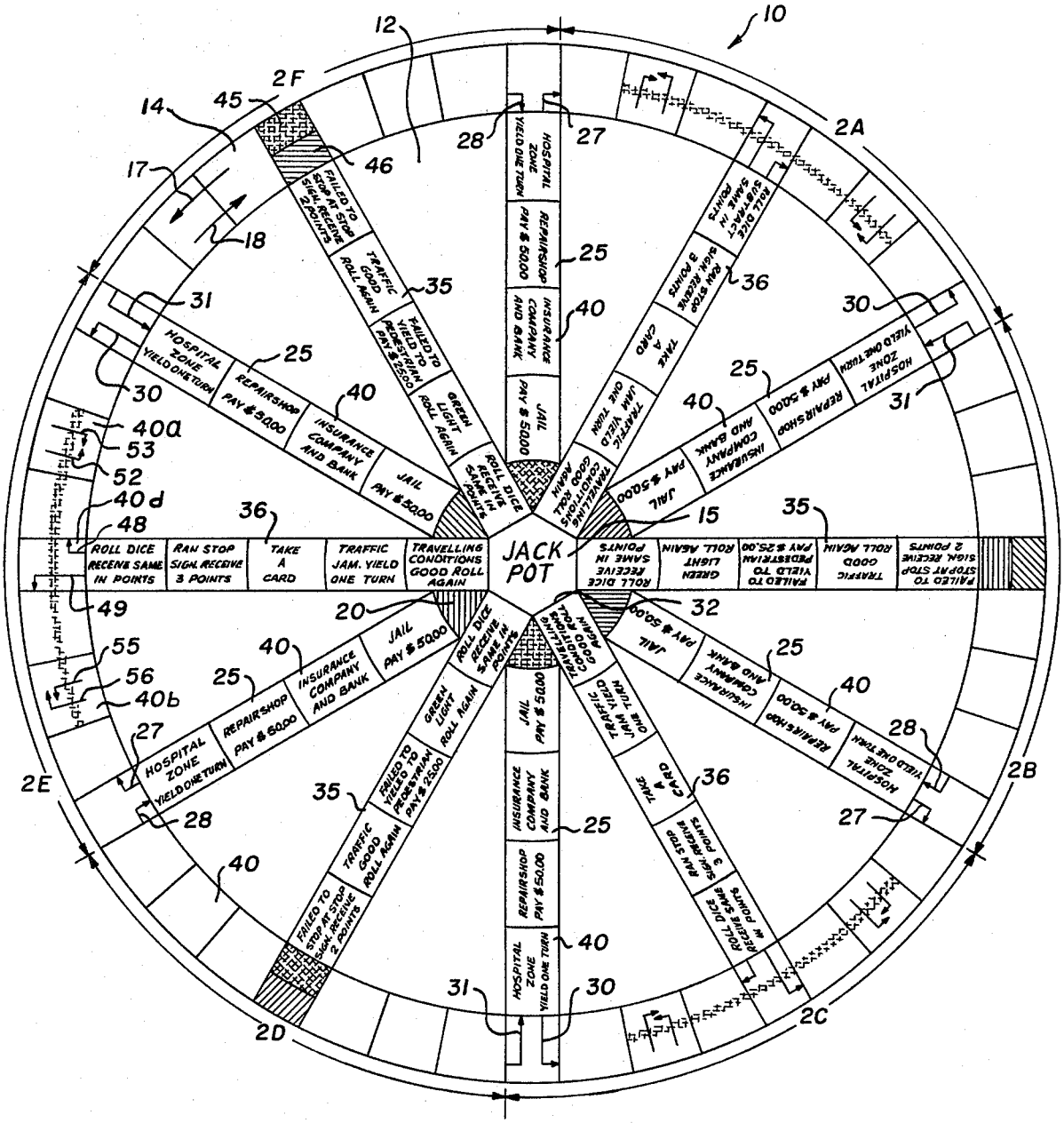
Figure 1A:
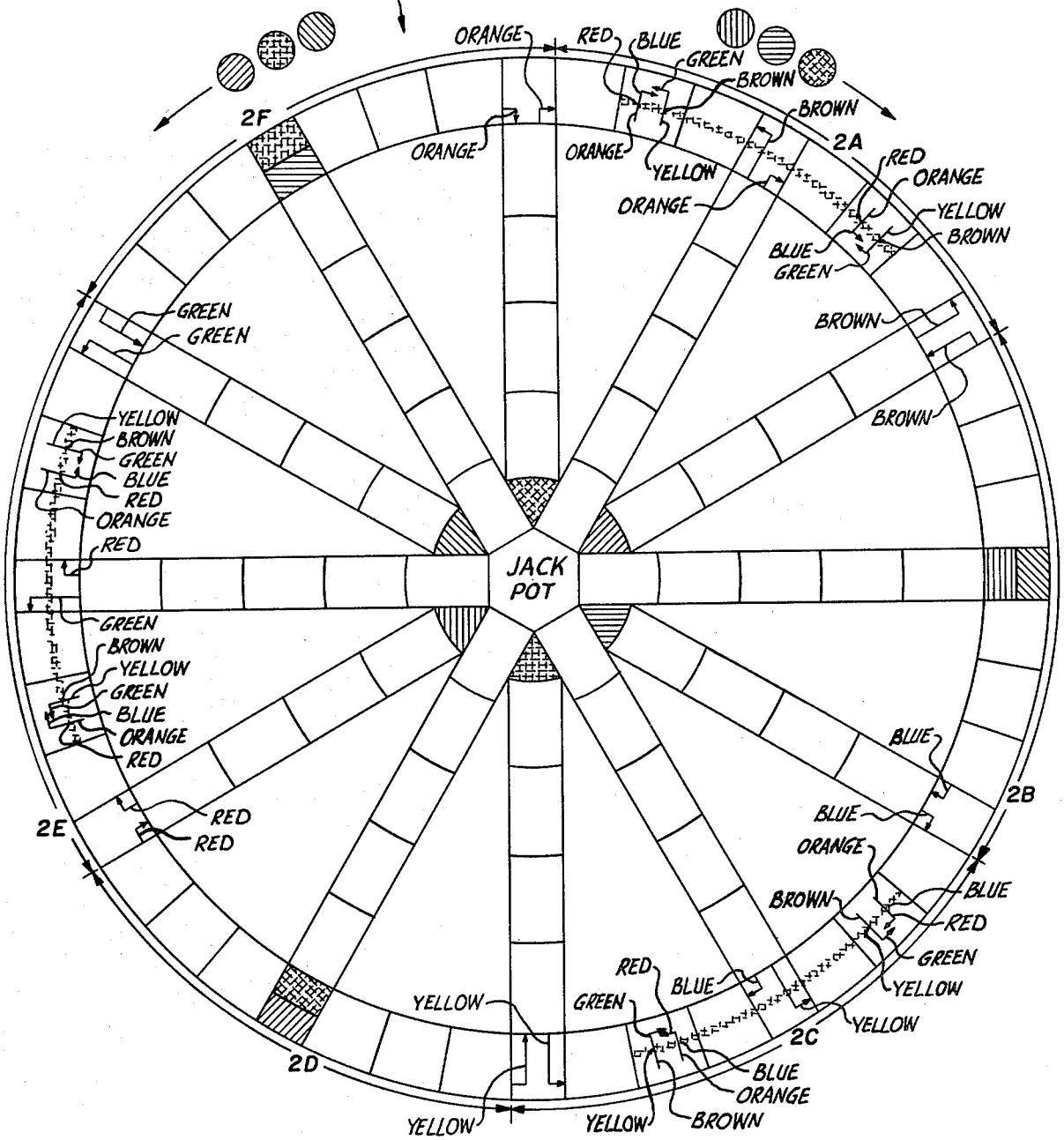
Figure 3:
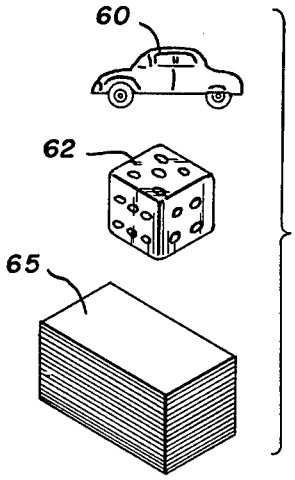
Figure 2B:
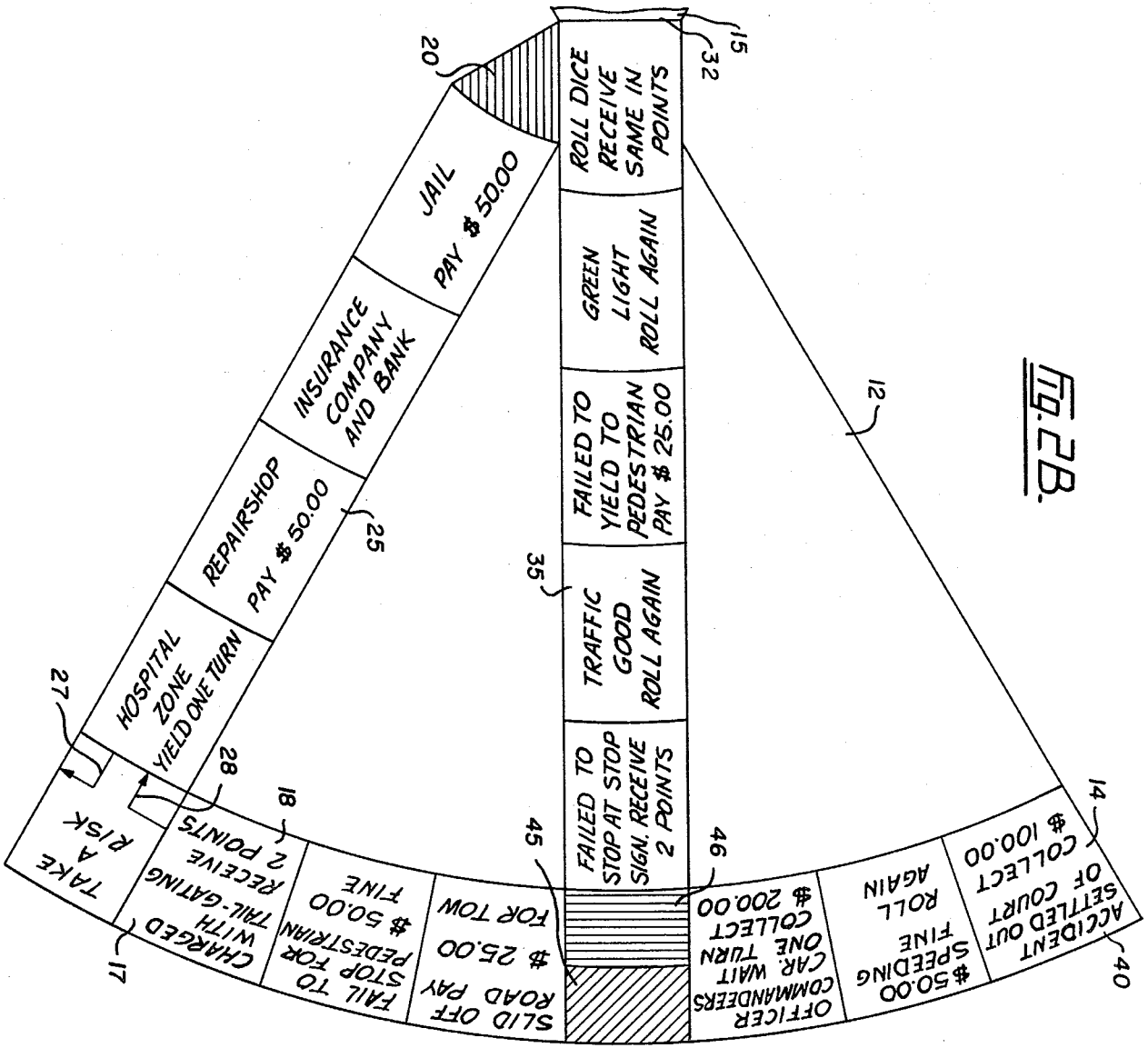
Figure 2C:
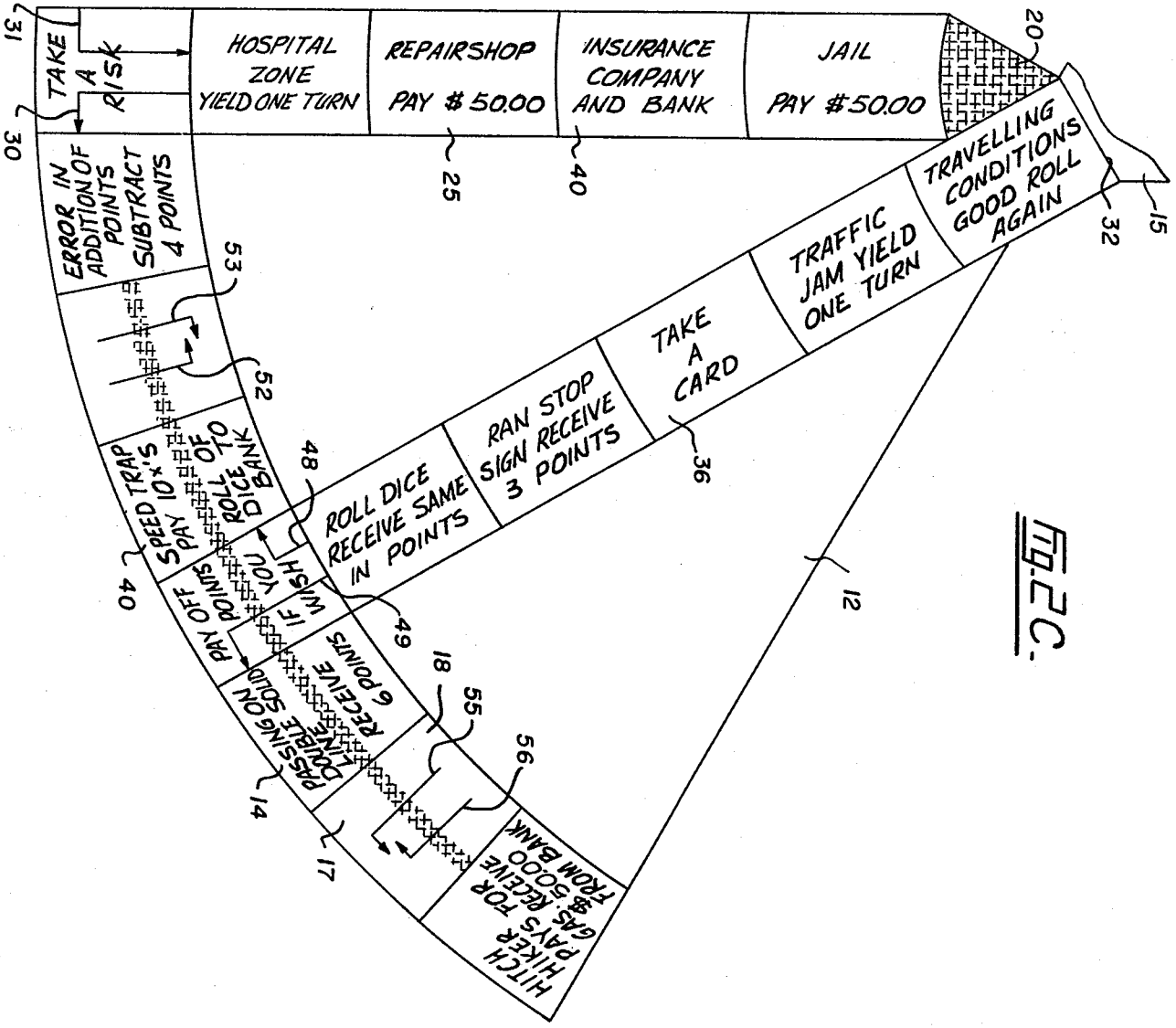
Figure 2D:
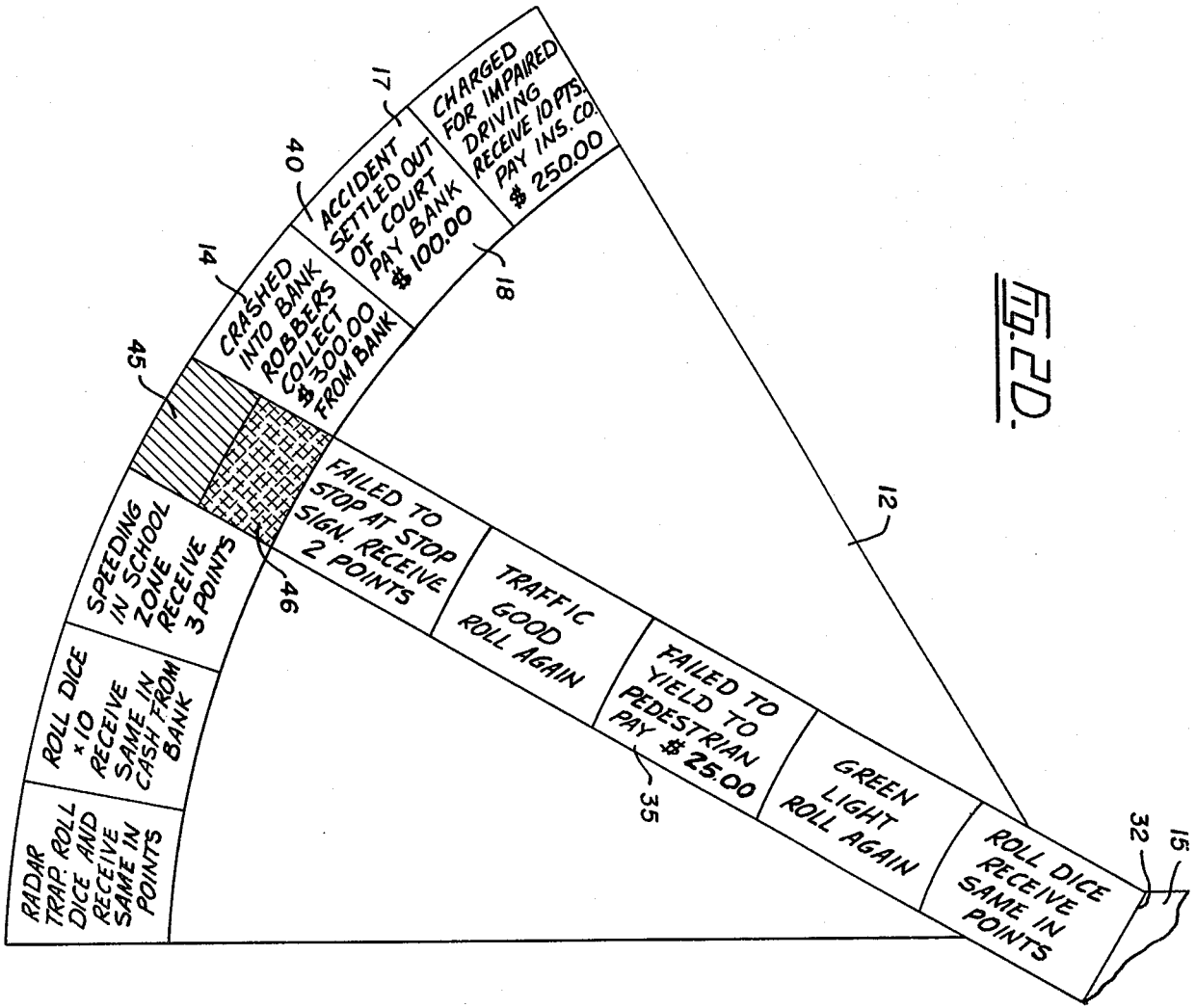

A preferred form of this invention is illustrated in the accompanying drawings, in which:

FIG. 1 is a plan view of the game board apparatus showing the main elements of the apparatus, but omitting the driving instructions of some of the indicator sections because of the smallness of the available spaces, FIG. 1A is the same as FIG. 1, but with the printing omitted, and indicating the colours of the directional arrows, FIGS. 2A to 2F are enlarged segments of the game board of FIG. 1, containing driving instructions, penalties and awards in the indicator sections, the location of these segments being indicated in FIG. 2, and FIG. 3 illustrates one of the playing pieces, a die and a stack of instruction cards used forming part of this game board apparatus.

Referring to the drawings, the game board apparatus 10 includes a game board 12 which may be of any shape, the illustrated board being round. Board 12 includes an endless two-way roadway 14 extending around a central area 15. The roadway 14 includes outer lanes and inner lanes 17 and 18 which extend throughout the length thereof. One of these lanes is designated for traffic moving in one direction and the other lane is for traffic moving in the opposite direction. For example, inner lanes 18 may be for traffic moving clockwise, and outer lane 17 for traffic moving counterclockwise.

Arranged around the central area 15 are a plurality of individual home areas 20. In this example each home area is of substantially triangular shape, and in the middle of central area 15 is a jack pot area 32 which, in this example is of hexagonal shape. There may be any desired number of home areas, and in this case there are six, and each home area has an identification different from all the other home areas. This identification may take any desired form, but the simplest and most satisfactory form is colour. The illustrated home areas are coloured green, red, yellow, blue, and brown and orange.

There is an in-out pathway 25 extending between each home area 20 and the roadway course 14. Some of these pathways communicate with the outer lane 17 and others with the inner lane 18 of the roadway course. For example, the pathways of the orange, red, and blue home areas communicate with inner lane 18, and this is indicated by out and in arrows 27 and 28. These arrows are preferably coloured the same as their respective home areas, but in view of the smallness of these arrows it is not possible to indicate these colours in the drawings.

Similarly, the pathways 25 of the brown, yellow and green home areas communicate with the outer lane 17, as indicated by the out and in arrows 30 and 31. These arrows also are preferably coloured the same as their respective home areas, but this is not shown in the drawings.

There are a plurality of inward detour roads 35 extending from the inner and outer lanes of the roadway course 14 to the central area 15, and a plurality of outward detour roads 36 extending from said central area to the inner and outer lanes of the roadway course. These inward and outward detour roads are alternately arranged with the pathways 25. As the illustrated example of this invention includes six home areas 20, there are six pathways 25, three inward detour roads 35 and three outward detour roads 36, said pathways and detour roads being alternatively arranged on the board. As the detour roads 35 and 36 extend into the jack pot area 32, their inner ends form the six sides of said jack pot area, and the home areas 20 are located between the road inner ends so that they are triangular in shape.

A plurality of indicator sections 40 are arranged in succession on the roadway course 14, the pathways 25, and the inward and outward detour roads 35 and 36. These indicator sections contain different driving instructions, penalties and awards. For example, each pathway 25 has four indicator sections 40 and these respectively contain the following:

Hospital zone yield one turn,
Repair shop pay $50.00
Insurance Company and Bank,
Jail pay $50.00.

The indicator sections 40 of the inward detour roads 35 and the outward detour roads 36 contain the following instructions:

Failed to stop at stop sign receive 2 points.
Traffic good roll again.
Failed to yield to pedestrian pay $25.00.
Green light roll again.
Roll dice receive same in points.
Ran stop sign receive 3 points.
Take a card.
Traffic jam yield one turn.
Travelling conditions good roll again.
Failed to stop at stop sign receive 2 points.
Roll dice subtract same in points.

Each inward detour road 35 has at its outer end indicator sections 45 and 46 in the outer lane 17 and inner lane 18, respectively. Sections 45 and 46 at the end of each road 35 are coloured the same as two different home areas 20, and the colours at the end of each road are different from the colours of the indicator sections at the ends of the other inward rows. In other words the colour of each home area appears at the outer end of one of the roads 35.

As an example, the indicator sections 40 of the roadway course 14 contain the following instructions:

Pulled police car from ditch subtract two points.
Witness to hit and run Ins. Co. gives you $200.00.
Pay off points if you wish.
Passing on double solid line receive 6 points.
Hitch hiker robs you of $50.00.
Take a risk.
Accident settled out of court collect $100.00.
$50.00 speeding fine roll again.
Officer commandeers car wait one turn collect $200.00.
Slid off road pay $25.00 for tow.
Failed to stop for pedestrian $50.00 fine.
Charged with tail-gating receive 2 points.
Hitch hiker pays for gas receive $50.00 from bank.
Passing on double solid line receive 6 points.
Pay off points if you wish.
Speed trap pay 10X's roll of dice to bank.
Error in addition of points subtract 4 points.
Radar trap roll dice and receive same points.
Roll die X10 receive same in cash from bank.
Speeding in school zone receive 3 points.
Crashed into bank robbers collect $300.00 from bank.
Accident settled out of court pay bank $100.00
Charged for impaired driving receive 10 points pay Ins. Co. $250.00
Littering highway pay $45.00 receive 2 points.
Car running fine roll again.
Gas station service slow wait one turn.
Radar trap police asleep roll again.
Not yielding right-of-way to emerg. vehicle receive 6 points.
Gas service station attendant gave too much change receive $50.00 from bank.
Disobeying detour sign pay $25.00 fine receive 2 points.
Accelerator stuck roll again.

A plurality of playing pieces are provided, one for each home area 20. In this example, there are six playing pieces 60, see FIG. 3, and each one is identified in the same manner as one of the home areas. For example, the six playing pieces simulate vehicles and are coloured orange, brown, blue, yellow, red and green. Any chance number indicating means may be used for determining the moves each player makes in his turn, and this may be a die 62, also shown in FIG. 3. However, a pair of dice, a spinning top, or the like may be used.

If desired, instruction cards including driving instructions, penalties and awards may form part of this game apparatus. FIG. 3 shows a stack of instruction cards 65. The following are some examples of instructions on these cards:

Noisy muffler or no muffler $10.00 fine.
Illegal U turn $10.00 fine.
Insurance renewal time pay $2.00 plus $10.00 for each point you have.
Dangerous driving fine $300.00 loss of license for 2 turns.
Criminal negligence go to jail $250.00 fine.
Wrong way on a one-way street $15.00 fine.
Passing on left when unsafe $25.00 fine.

The game 10 may be played by any number of players up to six, but it is preferable that at least two players play at a time. Each player is assigned a home area 20 of a certain colour and he has a playing piece vehicle 60 of the same colour. To start, each player puts his vehicle on his home area. When taking his turn, the player rolls die 62 and then moves his vehicle through a number of indicator sections 40 in accordance with the number which turns up on the die. For example, if the die number is 6, the player will count off six indicator sections in succession, while following the indicating arrows.

With the illustrated game, the orange, blue and red vehicles are moved clockwise in outer lane 17 of roadway 14, while the green, yellow and brown vehicles are moved counterclockwise in the inner lane 18.

For the purpose of illustration, the movements of one player will now be followed, for example, a player starting from the green home area and having a green vehicle 60. If the player rolls a 6, he counts out six indicator sections 40 in his pathway 25, the arrow 30 indicating a left turn into outer lane 17 of the roadway course 14. He lands on the indicator section which states "Gas station service slow wait one turn." This means he will miss his next turn when it comes around to him. He then progress counterclockwise along lane 17. If he lands on an indicator section having an arrow with his colour green and extending from the outer lane to the inner lane, such as arrow 53 in section 40*a*, see FIGS. 1 and 2E, he would be in the inner lane and moving counterclockwise which is the wrong direction for that lane. He continues in that lane until he arrives at a green arrow that will return him to his outer lane, such as arrow 55 in section 40*b* in FIGS. 1 and 2E. If the player encounters a vehicle moving in the direction opposite to him in the inner lane, this would lead to a head on collision and he is penalized in accordance with the rules. If the player lands on a green section 45, see FIGS. 1 and 2B, he must run in and move along the inward road 35 of that green section. He will continue counting in along the inward road and then along an outward detour road 36 having a green arrow extending outwardly therefrom into the outer lane 17 and pointing in the counterclockwise direction, this being arrow 49 in section 40*d* in FIGS. 1 to 2E. If the player lands on jack pot area 22 during this detour, he collects a bonus in accordance with the rules. Should the player move past a vehicle in the outer lane and moving in the same direction, this constitutes a rear end collision, and a penalty is awarded accordingly. When the player gets back to his pathway 25, the green arrow 31 will direct him into the path and eventually back to his green home area 20.

Another player, for example, the one on the red home area 20, would be directed from his pathway 25 by the red arrow 27 at the outer end thereof into the inner lane 18 of the roadway course so as to move in a clockwise direction. Eventually red arrow 28 directs this player back on to his pathway 25. The player that gets home first is the winner, and the remaining players can continue to play until they are all home so as to determine their finishing order.

The game is played with imitation money or other counter tokens having predetermined values. One player acts as banker and insurance company operator. Each player must keep in mind that he is concerned only with arrows either fully or partially coloured the same as his home area and playing piece. Each player starts with a predetermined amount of money and with zero points. The points are similar to those used in some traffic codes where a driver is assessed predetermined numbers of points for different misdemeanors, and when he reaches a predetermined number of these, he is penalized in some way. If a player runs out of money, he can go back to the "bank" indicator section near his home area to borrow more money, in which case on his next move he starts from that bank.

If the player accumulates more than 15 points, he will go back to the "insurance company" section near his home area and pay the points off at so much a point, for example, $10.00 per point. This money is put into the jack pot area 22. If a player lands on the jack pot area, he receives all the cash accumulated therein. Losses of $50.00 and under are placed in the jack pot area. When an accident occurs with another player, the consequences for that accident apply. Penalties for head on collisions may be both players going to the hospital in their home pathways, the player in the wrong paying a fine of $125.00 and being assessed 6 points, while the innocent player loses a turn and receives $150.00 from the other party. If a player is entering or exiting from a detour road and another player is directly in his path, that would be a side collision. The party doing the hitting moves to a "repair shop" section while the other party involved receives $100.00 from the guilty party. When a player rear ends another, the player in the wrong pays a fine of $125.00, goes to the "repair shop" section and pays the other party $100.00 as a wipelash settlement. The other party goes to the nearest hospital. If a player lands on a "take a card" section 40, he picks up an instruction card 65 and follows the instructions contained by it.

Other situations, penalties and awards appear in the indicator sections of the illustrated board 12. It is obvious that the directions, penalties and awards of the game can be set up as desired.

I claim:

1. Driving game board apparatus to be played by the use of chance number indicating means, comprising a game board;

an endless two-way roadway course on the board spaced outwardly from and extending generally around a central area of the board, said roadway course having an inner lane and an outer lane extending throughout the length thereof;

a plurality of individual home areas arranged around the central area of the board, each of said home areas having an identification different from the others of said home areas, a plurality of playing pieces simulating vehicles, one for each home area and having the identification of said home area, an in-out pathway extending between each home area and the roadway course;

means directing a playing piece on a first group of said in-out pathways to the outer lane;

means directing a playing piece on a second group of said pathways to the inner lane;

a plurality of inward detour roads extending from the inner and outer lanes to said central area;

each of said outward detour roads being marked at an outer end to direct playing pieces onto the inner lane and onto the outer lane of the roadway course;

a plurality of outward detour roads extending from the central area to the inner and outer lanes;

each inward detour road having the road indicator section respectively in the inner and outer lanes, said road indicator section of each inward detour road having two different identifications the same as two different identifications of home areas, and the identifications of the road indicator sections of each of said inward detour roads being different from the identifications of the road indicator sections of all the other of said inward detour roads; and a plurality of indicator sections in succession on the pathways, the roadway course and the inward and outward detour roads and containing different driving instructions, penalties and awards.

2. Driving game board apparatus as claimed in claim 1 in which said home areas are arranged generally in a circle, and said pathways radiate from the home areas.

3. Driving game board apparatus as claimed in claim 2 in which the detour roads radiate from the central area of the board, and are alternately arranged with the pathways.

4. Driving game board apparatus as claimed in claim 1 in which the inner lane of the roadway course is designated for general movement in one direction and the outer lane of said course is designated for general movement in the opposite direction; some of said indicator sections on the roadway course having arrows indicating movement from the inner lane to the outer lane, and others of said indicator sections of the roadway course having arrows indicating movement from the outer lane to the inner lane.

5. Driving game board apparatus as claimed in claim 4 in which each of said some indicator sections has two arrows, indicating respectively movement in the direction of and counter to the general direction of movement of the outer lane, and each of said other indicator sections has two arrows indicating respectively movement in the direction of and counter to the general direction of movement of inner lane.

6. Driving game board apparatus as claimed in claim 5 comprising a jack pot area in the central area of the board, each of said inward and outward detour roads communicating at an inner end thereof with said jack pot area.

7. Driving game board apparatus as claimed in claim 1, in which the pathways of the first group are arranged alternately with the pathways of the second group.

* * * * *